US007210507B2

(12) United States Patent
Facchini

(10) Patent No.: US 7,210,507 B2
(45) Date of Patent: May 1, 2007

(54) CAPSULE FILLING MACHINE

(75) Inventor: Libero Facchini, San Lazzaro di Savena (IT)

(73) Assignee: B.L. Macchine Automatiche S.p.A. (IT)

( * ) Notice: Subject to any disclaimer, the term of this patent is extended or adjusted under 35 U.S.C. 154(b) by 173 days.

(21) Appl. No.: 10/511,206

(22) PCT Filed: May 8, 2003

(86) PCT No.: PCT/EP03/04821

§ 371 (c)(1),
(2), (4) Date: May 2, 2005

(87) PCT Pub. No.: WO03/094824

PCT Pub. Date: Nov. 20, 2003

(65) Prior Publication Data

US 2005/0217752 A1 Oct. 6, 2005

(30) Foreign Application Priority Data

May 13, 2002 (IT) ..... BO2002A0282

(51) Int. Cl.
*B65B 43/42* (2006.01)

(52) U.S. Cl. ..... 141/146; 141/144; 141/145

(58) Field of Classification Search ..... 141/144–147, 141/234, 235, 267, 268; 222/160, 168.5
See application file for complete search history.

(56) References Cited

U.S. PATENT DOCUMENTS

| | | | | |
|---|---|---|---|---|
| 3,580,302 | A * | 5/1971 | Riesenberg | 141/141 |
| 3,850,345 | A * | 11/1974 | Merritt | 222/168.5 |
| 3,889,726 | A * | 6/1975 | Stigler | 141/142 |
| 3,978,640 | A | 9/1976 | Crossley et al. | |
| 4,943,227 | A | 7/1990 | Facchini | |
| 5,626,171 | A * | 5/1997 | Mirri | 141/152 |
| 5,685,349 | A | 11/1997 | Mihail et al. | |
| 6,390,330 | B2 * | 5/2002 | Runft | 222/41 |
| 6,425,422 | B1 * | 7/2002 | Trebbi | 141/67 |

FOREIGN PATENT DOCUMENTS

| | | |
|---|---|---|
| WO | WO-01/70171 | 9/2001 |

* cited by examiner

*Primary Examiner*—Timothy L. Maust
(74) *Attorney, Agent, or Firm*—Stites & Harbison PLLC; Marvin Petry

(57) ABSTRACT

The capsule filling machine is provided with special volumetric dosing stations each having two or more adjacent dosing units (9, 9', 22), fixed at equal distances from each other on the periphery of the carousel and located outside and at a distance from the product feed hopper (2), in such a way that they can be rapidly and easily replaced when there is a change in the formal of the capsules to be filled, in the same way as all the other components of the machine, which is also designed for easy and rapid preparation for the washing and sterilization cycle.

34 Claims, 10 Drawing Sheets

9
6
43
44
P
42
44
19
22
D2
D1
124
24

9
6
43
44
P
42
44
19
D
22
33
36
34
C2
37
38
35
124
24

9
43
44
P
42
44
19
22
D
36
34
33
C2
37
35
124
24

CAPSULE FILLING MACHINE

In the course of the production and operation of the carousel-type capsule filling machine described in Italian patent application no. BO2000A 150 of 20 Mar. 2000, which was filed in the name of the present applicant and to which extensive reference will be made, certain improvements were discovered, these improvements constituting the subject of the present patent application. In order to make clear the new objects of the invention, it should be noted briefly that the machine which is referred to comprises a hopper containing the product, this hopper having a relatively flat shape and rotating about its own vertical axis, and being provided on the perimeter of its base with vertical and equidistant bushes which are closed below by movable self-concealing plugs and which are aligned with punch-type volumetric dosing devices, which are located above the bushes within the said hopper, are open at their lower ends, and are used for preforming doses of product which are subsequently transferred into the underlying bushes where each of the said doses, if formed from fibrous or powdered and compressible material, is first pressed in such a way that it remains in the bush when the lower end of the bush is subsequently opened and the base of a capsule is aligned with the lower end of the bush, the dose of product then being transferred into the capsule by a downward extended stroke of the piston of the dosing device. With this essentially sealed system, using dosing devices housed separately in the product hopper, it is also possible to dose very free-flowing products such as microgranules, pellets or the like, by means of volumetric dosing devices with suction pistons.

The following problems were encountered in the production and use of this type of machine.

The punch-type dosing device, which is plunged cyclically into the product to be dosed, is subject to frictional wear which progressively decreases the polish and smoothness of the surfaces. This phenomenon causes some contamination of the product with metallic substances, but most significantly it progressively increases the friction between the body of the dosing device and the product, thus subjecting the product itself to friction, overheating and localized pressure, which can modify its characteristics and which in some cases require fluidization operations to restore the flowability and uniformity of the layer of product into which the dosing devices have to be plunged cyclically. The optimal operating condition of the punch-type dosing device is one in which, at the end of the downward travel, the punch reaches a point as close as possible to the upper end of the underlying bush, but obviously without touching the bush, as this would damage the cutting edge of the said punch. This condition is not only difficult to establish at the time of adjustment of the various operating components of each station of the carousel, but can also cause rapid wear of the lower cutting edge of the punch of the dosing device and the top of the bush, when the material for dosing is fibrous in nature and particularly strong, since some of this material inevitably remains trapped and pressed between the said two parts at the end of each working travel of the dosing device. This wear causes further contamination with metallic substances and deterioration of the characteristics of the product for dosing.

In order to resolve these and other problems of reliability, and to simplify the construction of the machine, the inventor initially considered the idea of using volumetric dosing devices with fixed bodies, for example of the type used in the machines for producing tablets of compressible product as described for example in U.S. Pat. No. 4,943,227. Each of the dosing devices in question has a body which is fixed to the carousel of the machine and is provided with a cylindrical chamber having a round cross section, parallel to the axis of the said carousel, with the end of a horizontal channel, formed radially in the said carousel and connected at its other end to the inside of the product hopper, opening into the intermediate part of the chamber. Opposing punches move slidably into the said chamber from its opposite ends, the outer ends of the punches being connected to axial drive means which cause them to operate as follows. At the start of each operating cycle, the punches are in the raised position, with a distance between them which forms a suitable free space in the chamber housing them, this space being connected to the said radial channel for feeding the product which enters this chamber under the action of gravity and centrifugal force. In a subsequent stage, the punches move downwards in step with each other, in such a way as to transfer the dose into the lower portion of the chamber which is isolated from the radial product feed channel, and in this lower portion of the chamber the punches are moved towards each other to compress the dose of product and form the tablet. In the next stage, both punches move downwards in such a way that they emerge from the lower end of the dosing chamber and the lower punch moves away from the upper to enable the tablet to be discharged, after which both punches are raised to repeat the described cycle.

Such dosing devices cannot be used in capsule filling machines, since during the dosing of the products, which tend to incorporate a large amount of gas, it would be difficult to eliminate the gas from the dose of product in the compression stage which is required before the lower end of the dosing chamber is opened, so that the capsule to be filled can be brought up to this lower end, and so that the dose of compressed product is retained by friction in the chamber in which it has been formed. Moreover, during the extraction of the lower punch from the dosing chamber, the punch itself would create a cavitation effect under the dose of product and some of the dosed product could inevitably pass out of the lower end of the dosing chamber together with the said lower punch. Evidently, the need to provide a modulated operation of the lower punch would considerably complicate the construction of the machine.

The invention is intended to overcome these and other drawbacks with the following idea for a solution. The lower punch or stop of a dosing device of the aforesaid type is used only to close or open the lower end of the dosing chamber. In addition, the closing is carried out in such a way that, at least when compressible products are dosed, a small quantity of gas can be vented In a controlled way in the area of contact between the lower stop and the dosing chamber. The lateral aperture of the dosing chamber, connected to the product feed channel, is constructed in such a way that its lower end is at a short distance from the base of the said chamber, so that, during the compression of the product, the dosing chamber always remains in communication with the said feed channel, so that most of the gas contained by the dose of product being compressed can flow back through the channel. The lateral aperture of the dosing chamber, through which the product enters, is also shaped suitably in the area in which it opens into the said chamber, in order to facilitate the entry of the product into the chamber, to help to retain the compressed dose of product in the chamber, and to ensure that the dose of product outside the chamber is separated by cutting at the point when the lower stop is moved away and the upper punch, with its sharp lower edge, completes its maximum downward travel, to discharge the previously compressed product from the lower end of the chamber and insert it into the base of the gelatin capsule.

It is also possible to use volumetric dosing devices with the suction type of piston in the capsule filling machine according to the invention, for packaging microgranules, pellets or the like in the gelatin capsules.

In compressing machines which use volumetric dosing devices with fixed bodies and opposing movable punches, as stated above, the said dosing devices are fixed to the outer wall of the product feed hopper, so that they can be replaced easily and rapidly when there is a change in the format of the product for packaging. The upper punches of dosing devices of this type, and the upper pistons of volumetric dosing devices of the punch type used in capsule filling machines of the known type, are at present driven by means located in the upper part of the carousel, using a solution which complicates the construction of the machine and can cause dirt to fall into the dosing devices located below. It should also be noted that, in capsule filling machines, the means responsible for the orientated feeding of the capsules into the opening and closing stations, requiring vertical and horizontal movements, are normally located at the same height as the dosing devices and outside the devices. In the known art, these movements are obtained from cams which are also located in the upper part of the machine, above the hopper, whose overall dimensions cause constructional problems in relation to the positioning and use of these cams.

In order to overcome these and other previously mentioned drawbacks, the dosing devices are separated from the product hopper and are positioned at an exact distance from, and at a lower level than, the said hopper, being located on a theoretical circumference coaxial with the carousel but having a radius greater than that of the base of the said hopper, and being connected by means of upwardly converging channels to corresponding lower perimetric discharge holes of the said hopper, which is made in a conical shape to enable the product for packaging to be discharged completely through the said perimetric holes.

This solution has yielded the following important advantages. The cams for driving the means for the orientated feed of the capsules can also be located under the product hopper, within the carousel and on the base of the machine. The fixed chamber volumetric dosing devices are grouped in sets of two or more in a single body which is fixed laterally to the carousel in a simplified and removable way, to accelerate the format change operations for adapting the capsule filling machine to the different dimensions of the capsules to be filled. The said dosing devices can be fixed with sufficient projection on the supporting carousel, so that sufficient space remains to the side of the devices for the location of a pair of vertical rods which are guided into the base of the machine where they are connected to a traveller which follows the profile of a cam located coaxially in the base of the machine, together with all the other cams of the said machine, and the ends of a link which supports the bodies of the pistons of the dosing devices are fixed to the upper ends of the said rods.

A further advantage derived from having the dosing devices separated from the product hopper and positioned under the said hopper is seen at the stage of washing the machine, when the closing stops of the dosing chambers are lowered, the pistons of the dosing devices are raised above the normal height, and the fluid for washing all the internal parts of the hopper can pass through the chambers of the dosing devices in sequence, thus washing them thoroughly and subsequently passing out of the dosing devices and falling into an underlying annular tank which also collects and discharges the liquid for cleaning the outer parts of the dosing units and the capsule handling units.

In the known capsule filling machine, to which reference has been made in the introduction, the stop means which close the lower ends of the lower bushes of the product hopper consist of parts movable radially on the carousel, which are subject to bending stresses during the compacting of the product in the bushes by the pistons of the dosing devices, and which inevitably introduce friction and corresponding wear into the system. These drawbacks are overcome by the use of the aforesaid fixed-body dosing devices, in which the lower closing means consist of push rods which are fixed to the carousel so that they can be raised and lowered, which operate in compression and which obtain the necessary raising and lowering movement from a cam located within the carousel and in the base of the machine.

Another problem which was to be resolved was that of enabling the purchaser of the machine to increase the operating capacity of the said machine when necessary, by keeping the rotation speed unchanged and modifying the number of operating elements of each station of the said machine, by the simple and rapid replacement and/or addition of a few components on means of support and/or movement which have been previously provided for the purpose and which require no modification.

In the preceding machine, the product placed in the hopper is impelled towards the dosing stations partly by gravity, but mainly by the centrifugal force generated by the rotation of the carousel. Since the impelling forces can vary with the rotation speed of the machine, the quantity of product present in the hopper, and other parameters, provision is also made to improve the feed of the product to the dosing devices, particularly in the case of less readily flowing products, by creating an impelling force in the hopper with inert gases at an appropriate pressure, which also helps to fluidize the product towards the dosing devices and enables precise and repeatable doses to be obtained even with simplified versions of the machine in question, which are usable as laboratory machines for testing the behaviour of products for packaging, each of these machines being provided with at least one fixed dosing station served by the fixed and pressurized product hopper and provided with cams which, unlike those in the continuous carousel machine, rotate about their axes to transfer the necessary movement to the various components of the machine. The process and the means for pressurizing the product hopper have been protected by a separate patent application, since they are usable for any other type of machine, even if different from the machine discussed here, which is required to form doses of bulk products.

In the preceding capsule filling machine, the closing of the full capsules required complicated movements of the mechanism for handling the empty capsules. In the machine according to the invention, the full capsules are closed by using the lower rounded points of the pushers which orientate the empty capsules with their bases downwards, and using the normal position of the end of the downward travel of these pushers.

These and other characteristics of the machine in question, and the advantages derived therefrom, will be made clearer by the following description of a preferred embodiment of the machine, illustrated purely by way of example, without restrictive intent, in the figures of the attached sheets of drawings, in which.

Figure 1:
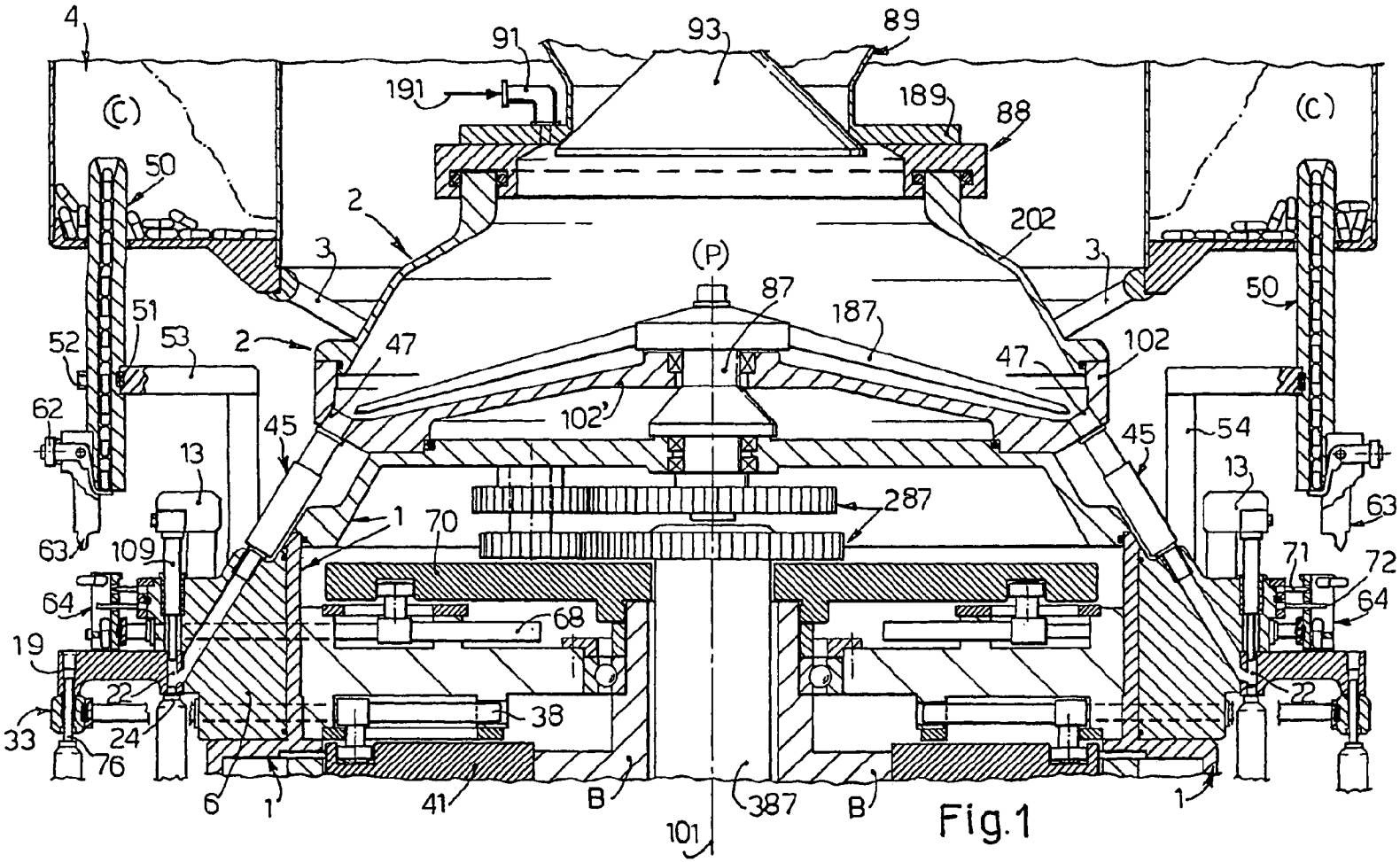
FIG. 1 shows the intermediate part of the carousel-type capsule filling machine, seen in section through a vertical plane which contains the axis of rotation of the said carousel.
Figure 2:
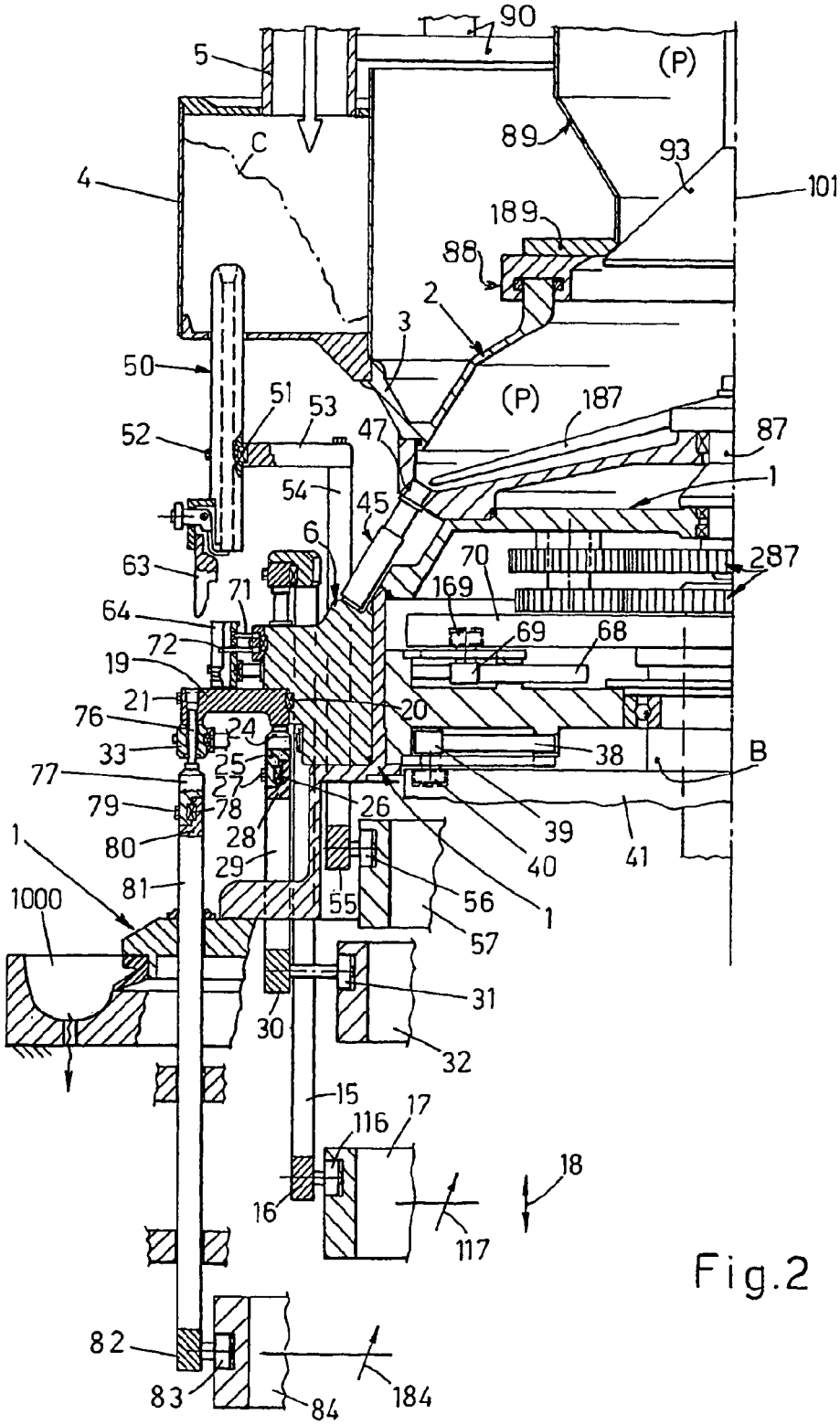
FIG. 2 shows the intermediate and lower part of the carousel-type capsule filling machine, seen in section as in the preceding figure.

In FIGS. 1 and 2, the number 1 indicates the carousel which rotates about its vertical axis 101 and on which the hopper 2 for feeding the product P to be dosed and packaged is fixed coaxially and removably, the hopper being preferably of conical shape, diverging downwards, with its base raised in the centre, a fuller description of this hopper being given subsequently, with additional reference to the means which feed it axially in a sealed way and which are fixed to the base of the machine. By means of supports 3, the hopper 2 holds axially and in a slightly raised position the annular basket 4 in which the empty and partially closed capsules C are placed in a loose state, the capsules being fed through a fixed channel 5 located in the higher and inner part of the basket, since the said capsules tend to accumulate in the outer part of the said basket as a result of centrifugal force.

Figure 3:
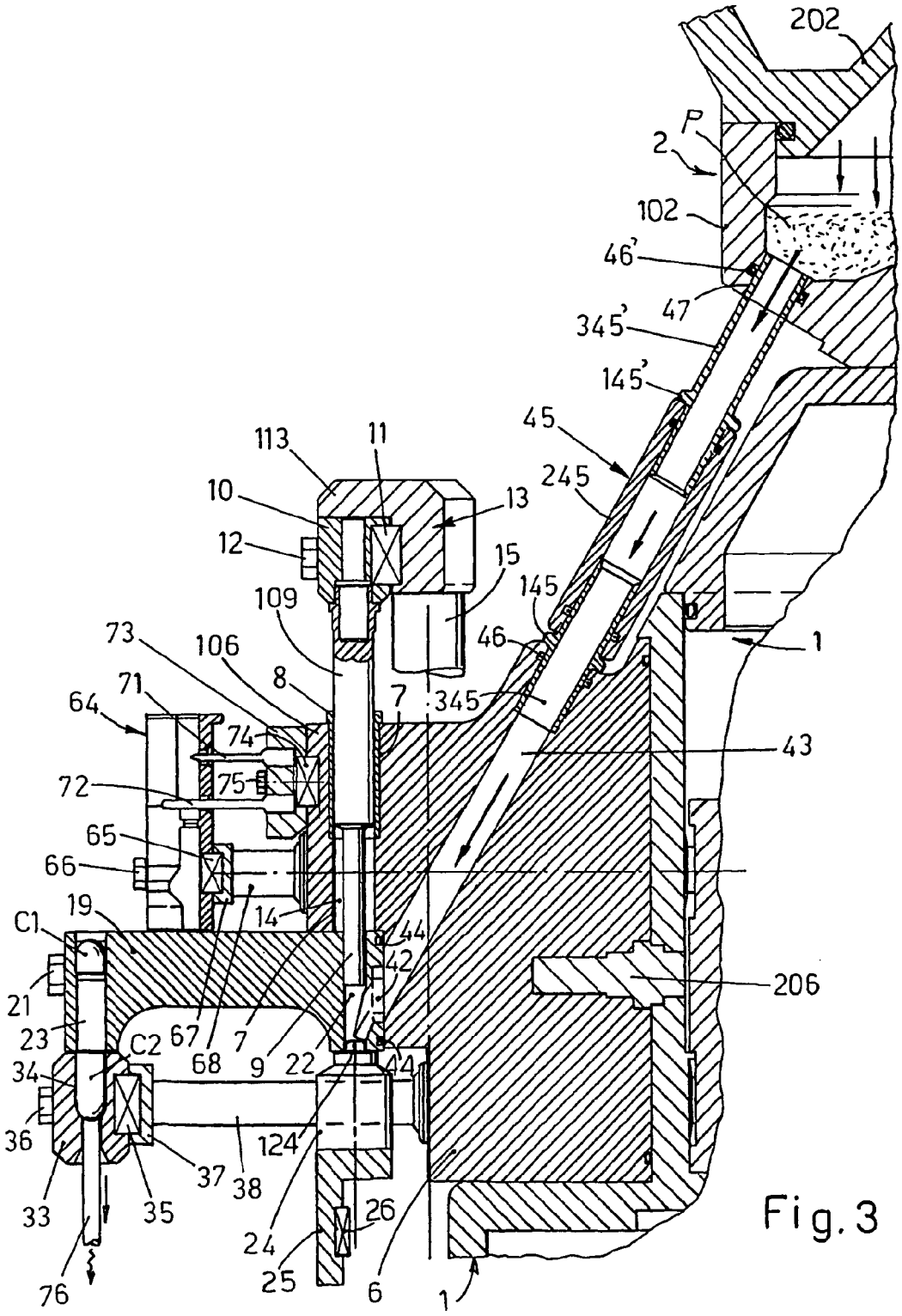
FIG. 3 shows a volumetric dosing station of the capsule filling machine, particularly for compressible products, seen on an enlarged scale and in section as in the preceding figure.
Figure 4:
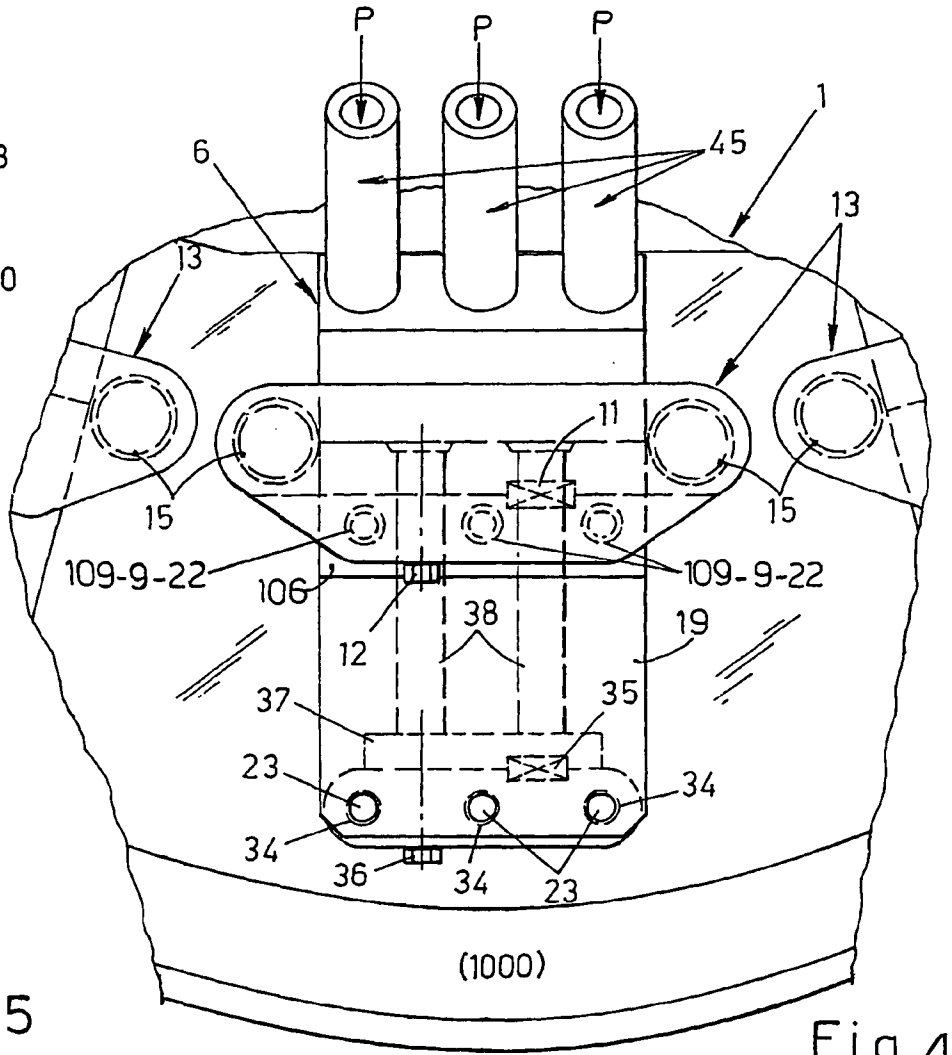
FIGS. 4 and 5 are a view from above and a front elevation, respectively, of a dosing unit according to FIG. 3.
Figure 5:
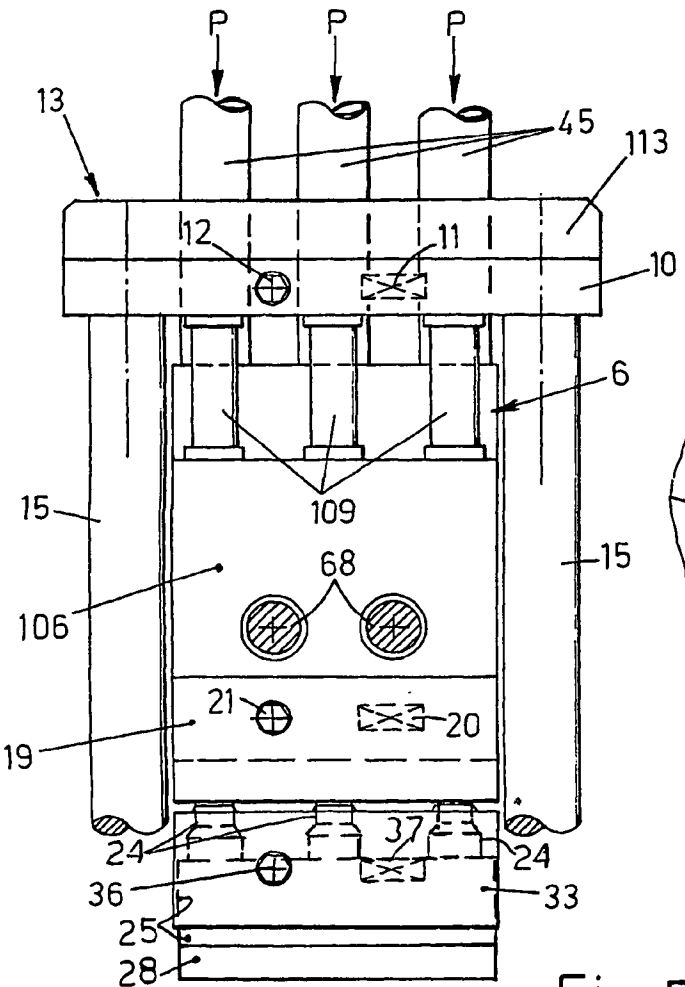

With additional reference to FIGS. 3, 4 and 5, it will be seen that identical bodies 6, of essentially rectangular plan, are fixed by means of fastenings 206, in succession to each other and with equal spacing between them, on the periphery of the carousel 1, below the hopper 2, each of these bodies having, on its face opposite that which is fixed to the carousel, a projecting upper part 106 through which pass two or more identical vertical holes 7, three for example, positioned with their axes on vertical theoretical plane and tangent to a circumference whose centre lies on the axis 101 and whose diameter is appropriately greater than the basic diameter of the hopper 2. The holes 7 are enlarged in an upper portion in which is engaged a bush 8 of material with a low coefficient of friction, in which the body 109 of the piston 9 of the volumetric dosing device slides, the piston having a diameter not exceeding the internal diameter of the base of the capsule to be filled and having a length such that the piston emerges from the lower end of the hole 7. For the dosing of compressible powdered or herb-based products, the assembly 9, 109 is made in one piece, and the edge of its lower end forms a sharp cutting edge. The upper end of the body 109 of the piston of each dosing unit is fixed perpendicularly to a cross-piece 10 which is fixed laterally and in a rapidly replaceable way, by means of a key or pin 11 and at least one screw 12, to a link 13 which has an appendage 113 mounted over the top of the said cross-piece 10 to improve the transmission of the axial forces to the pistons. In turn, the ends of the link 13 are fixed to a pair of vertical rods 15 which are guided into the carousel 1 and whose lower ends are fixed to a traveller 16 which has a lateral roller 116 which follows the double-acting profile of an annular cam 17 for transmitting the aforesaid axial movements to the pistons of the dosing devices. The cam 17 is fixed to the axial base column B with the interposition of a vertical slider controlled by a screw and nut servo controller with a remotely controllable motor, as indicated schematically by the arrow 18, by means of which this cam can be kept in a low position, with the pistons 9 and 109 in the operating position, or can be raised to bring the said pistons 9, and if necessary also their bodies 109, out of the corresponding guide bushes 8, to enable the said pistons to be rapidly replaced when the capsule format is changed, and to prepare the dosing units for the washing and sterilization cycle (see below). Additionally, the said cam 17 is of the type in which the Inclination of the rising and falling ramps, at least for the dosing and compression stages, can be varied remotely from zero to a value specified from time to time, by means of screw and nut servo controllers and motors with electronic speed and phase control, which are known and are therefore not illustrated. This solution provides, for example, the important advantage of making it possible to detect at any time the idle rotation of the capsules in the machine, and to stop the operation of the dosing devices temporarily, to prevent unnecessary wastage and loss of product. The dosing devices are put into operation only when it has been ascertained that the capsule handling means are functioning correctly.

A bracket 19 is fixed removably and in such a way that it is rapidly replaceable, for example by means of a key or pin 20 and a screw 21, under the upper projecting part 106 of the body 6. The bracket 19 contains the cylindrical, vertical and open-ended chambers 22 for the formation of the doses of product, into which the pistons 9 slide in a precise way, and contains, for each chamber 22 and at the same distance from each chamber, vertical open-ended housings 23 of a known type, with portions of downwardly decreasing diameter, in which the capsules C are opened and closed, each of these housings being provided with an upper portion which houses the cover C1 of the capsule with a certain amount of clearance, and a lower portion whose diameter is such that it prevents the passage of the said cover C1, which therefore remains in the upper portion of the housing, while allowing the base C2 of the said capsule to pass through.

The chambers 14, which are located above the chambers 22 and into which the bodies 109 of the pistons 9 slide, communicate freely with the atmosphere through at least any one vent aperture (not illustrated), to prevent the formation of undesired pressures or vacuums in the said chambers as a result of the alternating axial movement of the said bodies 109.

The housings 22 are closed at their lower ends by corresponding plugs or stops 24, integral with a cross piece 25 which is fixed removably and in such a way that it is rapidly replaceable, for example by means of a key 26 and a screw 27, to a cross piece 28 which in turn is fixed to the upper end of a pair of vertical rods 29 which are guided into the carousel 1 and whose lower ends are fixed to a traveller 30 whose roller 31 follows the double-acting profile of an annular cam 32 fixed to the base column B. When the machine is to be used for dosing compressible powdered or herb-based products, each stop 24 is preferably provided at its top and coaxially with a cylindrical projection 124 which partially enters and engages with a very small lateral clearance the lower end of the dosing chamber 22, in such a way as to permit sufficient venting of gas through this clearance during the compression of the doses of product in the said chamber 22 and to prevent cavitation phenomena in the stage in which the stop 24 is lowered (see below). The cam 32 has the function of moving the stops 24 into the raised position for closing the lower ends of the dosing chambers 22, or into a low position for opening the lower ends of the said chambers and preventing interference with a moving element which positions the corresponding bases C2 of the capsules to be filled under the said chambers 22. This moving element is formed by a cross piece 33 which contains vertical open-ended housings 34, each of which is shaped to contain the base C2 of a capsule and is open at its lower end, in a known way, with a hole which does not allow the base C2 to pass through, but which allows the passage of a push rod as mentioned previously. The cross piece 33 is fixed removably and in such a way that it is rapidly replaceable, for example by means of a key 35 and a screw 36, to a cross piece 37 whose ends are fixed to a pair of horizontal rods 38 which are guided into the carousel 1, where they are fixed to a traveller 39 whose roller 40 follows the double-acting profile of a disc cam 41 which is coaxial with the carousel and is fixed on the column B, by means of which the cross piece 33 with the housings 34 for containing the bases of the capsules can be aligned with the housings 23 or with the housings 22.

Apertures 42 are formed in the wall of the bracket 19 which is in contact with the body 6, thus putting each dosing chamber 22 into communication with corresponding inclined channels 43 formed in the body 6, and the area of connection between the parts 42 and 43 is surrounded by a seal 44. The channels 43 open on an upper wall, perpendicular to the channels, of the body 6, on which the annular projections 145 of composite tubular ducts 45 bear, these ducts being aligned with the said channels and having their opposite ends fitted, with seals 46, 46', into the said channels 43 and into holes 47 formed in a lower part of the perimeter of the hopper 2 which is essentially perpendicular to the said holes, this lower part forming the lowest area of the said hopper 2. Each duct 45 is formed, for example, by an intermediate sleeve 245 in whose opposite ends there are fitted, with lateral seals, tubes 345, 345' whose annular projections 145, 145' bear on the said sleeve. The ends of the tubes 345, 345' located within the sleeve 245 are suitably rounded and spaced suitably apart, in such a way that they promote the outflow of the product to be dosed and are better prepared for the washing and sterilization cycle (see below).

Figure 6:
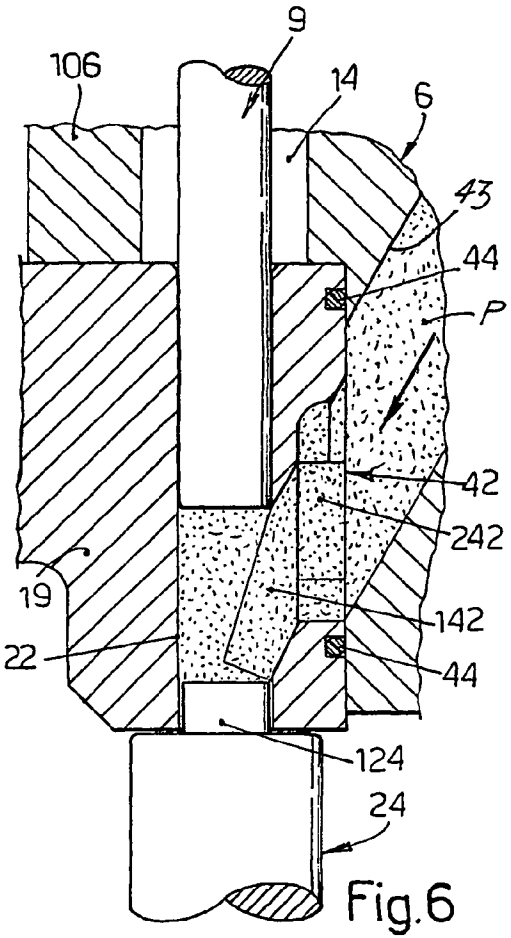

With additional reference to FIG. 6, it will be seen that, for the dosing of compressible powdered or herb-based products, the aperture 42 comprises a terminal part 142, which partially penetrates into the dosing chamber 22, has its upper and lower edges inclined downwards, and has its lower edge terminating just behind the head 124 of the stop 24 in its high position, and which creates in opposing areas of the lateral walls of the said chamber 22 recesses with sharp edges, orientated partially in the longitudinal direction and partially in the transverse direction of the said dosing chamber 22. The initial part 242 of the aperture 42 is wider than the said part 142, and forms an essentially diverging connection, free of dead zones, to the duct 43.

Figure 8:
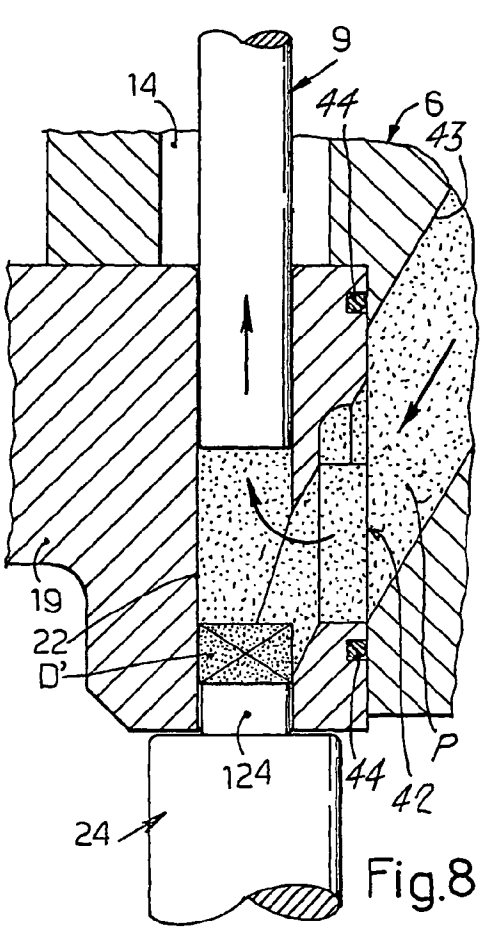
FIGS. 6, 7, 8, 9, 10 and 11 show, on an enlarged scale and in section as in FIG. 3, a dosing device for compressible products, during successive stages of operation.
Figure 7:
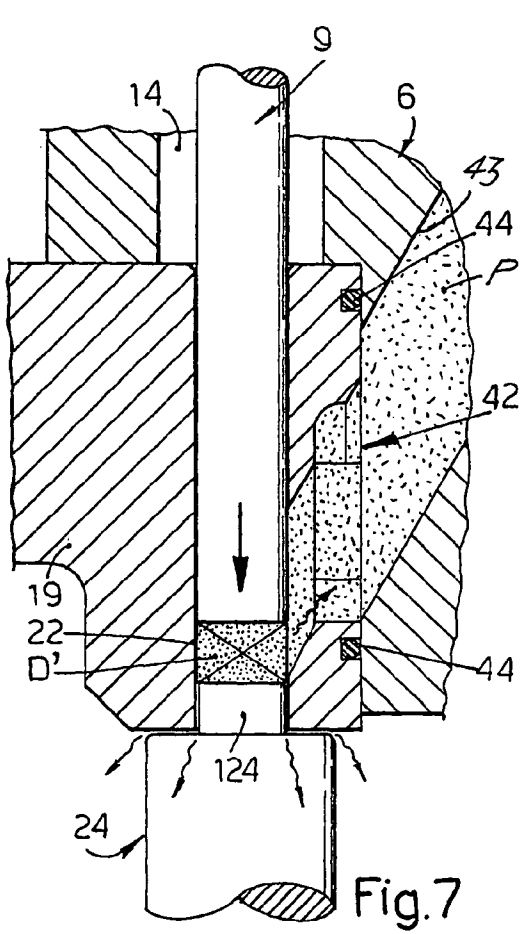
Figures 9, 10, 11:
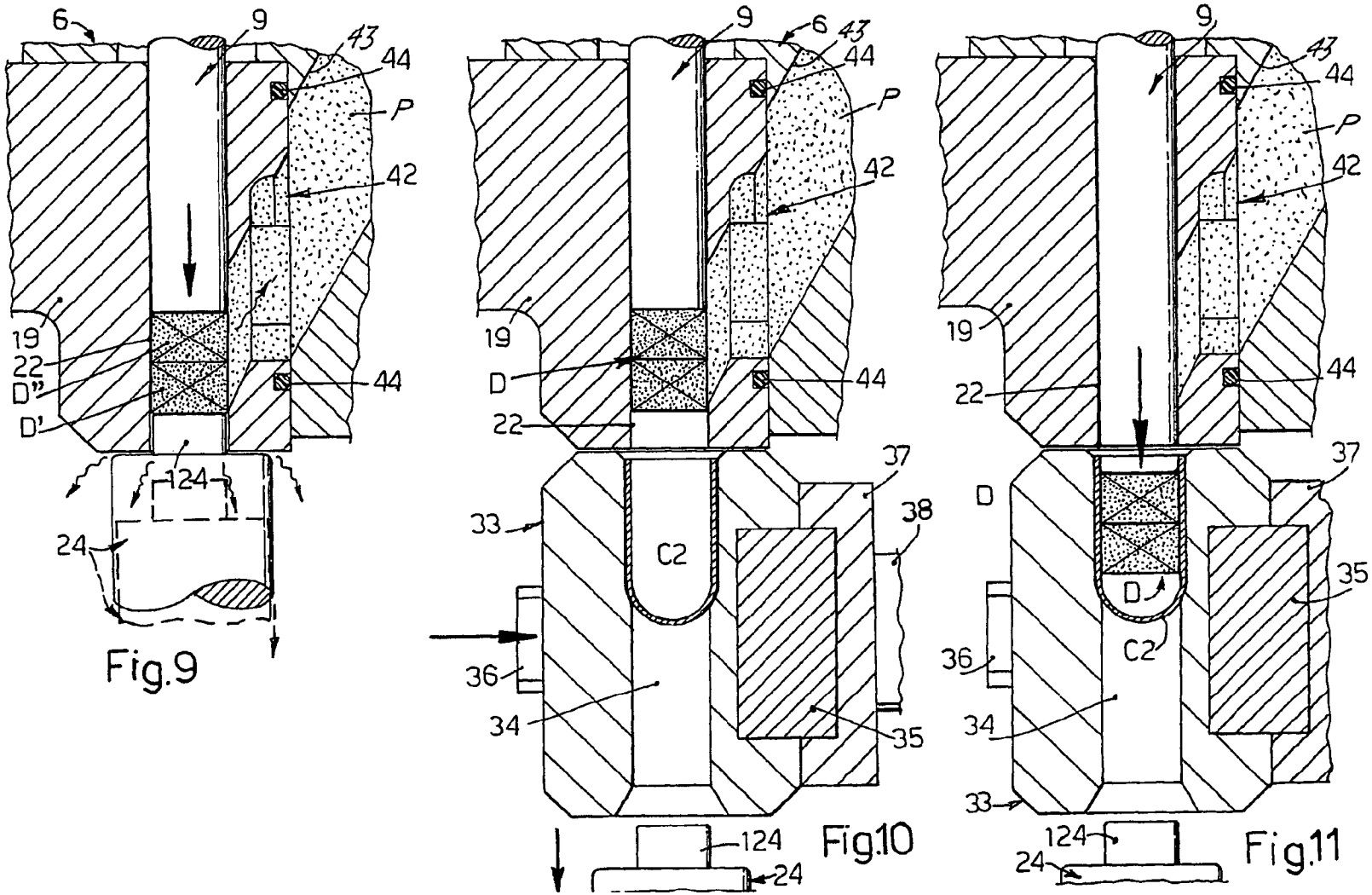

The machine with the dosing devices as described operates in a way which will now be described with reference to FIGS. 6 to 11. In the first stage of the operating cycle, the dosing chamber 22 is closed at its lower end by the stop 24, and the piston 9 is in the raised position, at a distance from the head 124 of the said stop which is proportional to the volume of the dose to be formed. The piston 9, which was lowered in a preceding stage (see below), has preferably been brought rapidly to the raised position, in such a way as to create in the chamber 22 a cavitation effect which is useful for drawing into this chamber the product P for dosing contained in the hopper 2, this product flowing downwards through the ducts 45, the channels 43, and the apertures 42, and finally filling the dosing chambers 22, this process being assisted by the action of means described below. The stage of filling the dosing chamber is followed by the stage of compression of the dose formed D', by the lowering of the piston 9 as shown in FIG. 7. In this stage, most of the gas contained in the dose of product subjected to compression is discharged through the channels used for feeding the said product, and a very small part is also discharged to the outside through the very small clearance between the head 124 of the stop 24 and the lower end of the chamber 22. In the next stage, if a second partial dose of product is required, the piston 9 rises rapidly as shown in FIG. 8 to free a suitable space in the chamber 22 above the dose D', this space being immediately filled with product, and the stage shown in FIG. 8 is followed by a subsequent compression stage as shown in FIG. 9, for forming the second dose D" of product. In this case also, a very small part of the gas contained in the compressed product is vented towards the outside through the parts 22 and 124, while most of the said gas passes through the aperture 42 which is still partially open. In the next stage, the stop 24 is lowered as indicated in broken lines in FIG. 9, to free the lower end of the chamber 22. The dose D of product, formed by the partial doses D' and D", is still partially connected to the product P which passes through the aperture 42 and which has also inevitably been affected by the compression caused by the piston 9 and has thus been partially compacted. When the lower end of each chamber 22 is opened by the removal of the stop 24, the dose D of product remains complete and solid in the chamber, as a result of the friction exerted against the walls of the chamber and as a result of the connection to the product, which is also compressed, penetrating into the recesses 142 of the aperture 42 which terminate in recessed areas on the opposing lateral walls of the chamber 22, and also because, owing to the small clearance between the head 124 of the stop 24 and the lower end of the chamber 22 and owing to the initially slow downward movement of the stop 24, this movement does not cause cavitation effects under the dose D. In the next stage, as shown in FIG. 10, the cross piece 33 with the bases C2 of the gelatin capsules is positioned and aligned, together with the said bases, under the dosing chambers 22, and the pistons 9 of the dosing chambers are then lowered, as shown in FIG. 11, to discharge the dose D of product into each base C2, separating the doses by cutting from the material remaining in the apertures 42 and completely closing these apertures and the dosing chambers. In subsequent stages which are not illustrated, the cross piece 33 with the full bases is moved transversely and brought back into alignment with the housings 23 (FIG. 3) and the stops 24 are raised again to close the lower ends of the dosing chambers 22, while the pistons 9 are raised at the correct time to open the apertures 42 only after the heads 124 of the stops 24 have engaged the lower ends of the chambers 22.

Figure 12:
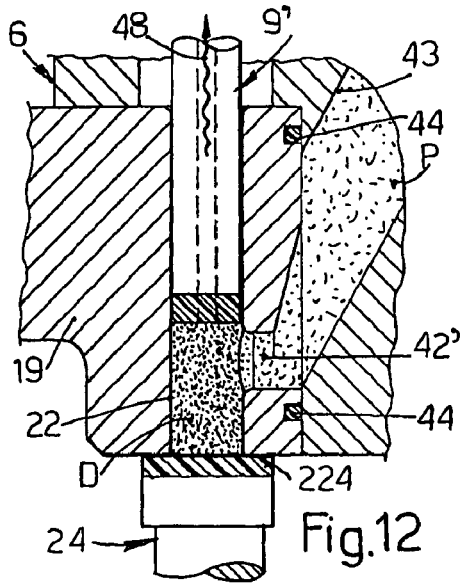
FIGS. 12, 13,14 and 15 show, on an enlarged scale and in section as in FIG. 3, a dosing device for highly fluid and non-compressible products, for example microgranular products, during successive stages of operation.
Figure 13:
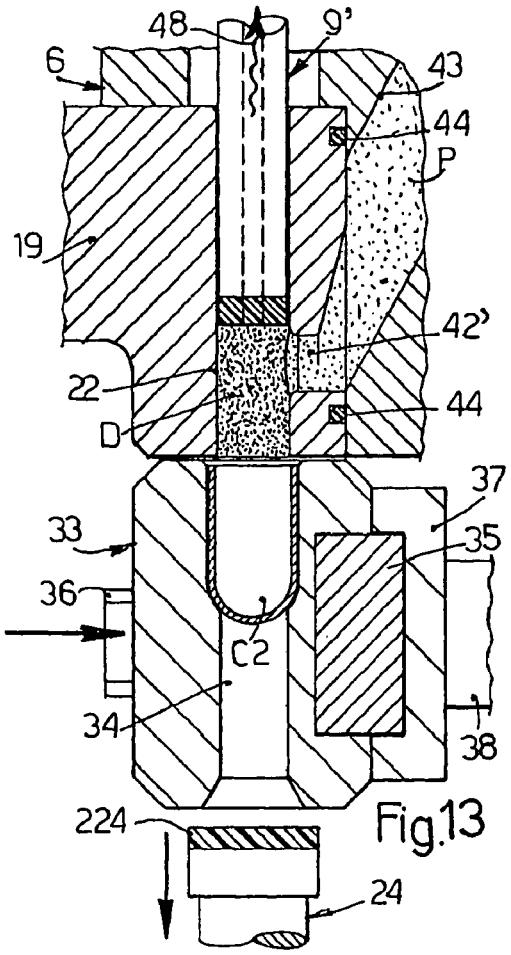
Figure 14:
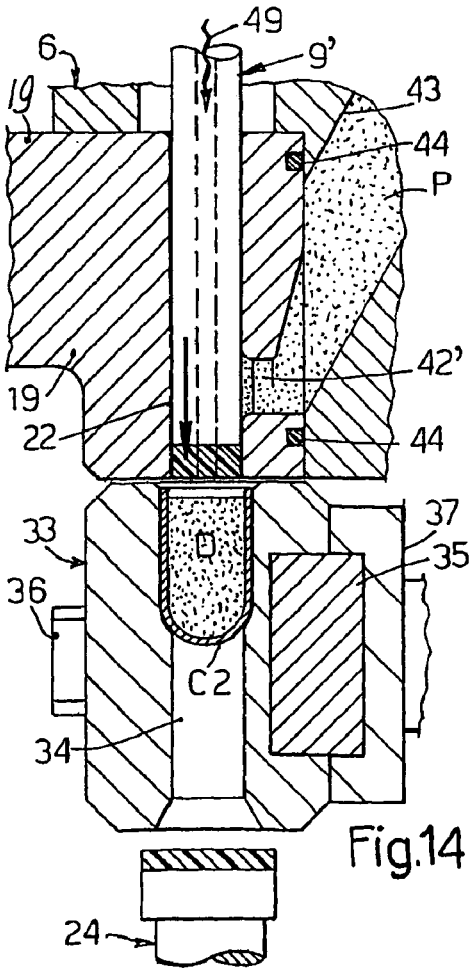
Figure 15:
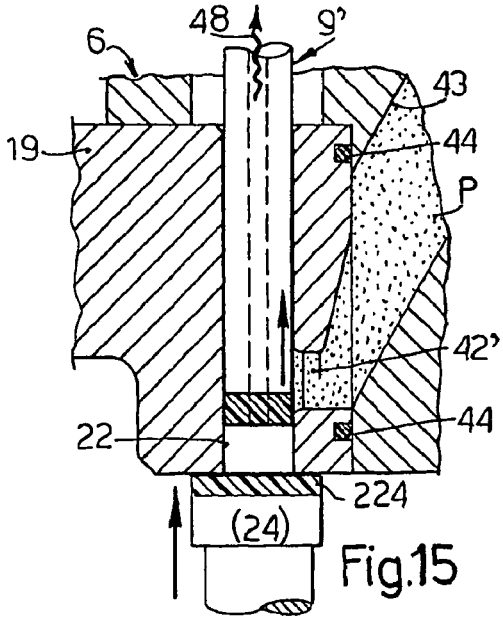

If the products to be dosed are very fluid and non-compressible, such as microgranule- or pellet-based products, the dosing chambers 22 are preferably sealed by the stops 24 and the dosing devices are constructed in the form which will now be described with reference to FIGS. 12 to 15. FIG. 12 shows that in this case each of the stops 24 terminates in a flat upper end on which is fixed a disc 224 of yielding elastic material which is pressed against the lower end of the chamber 22 in such a way as to seal it. The pistons 9' of the dosing devices are of the type in which the lower end of the piston has small apertures which retain the product to be dosed but through which a flow of gas can pass, these pistons being axially hollow and connectable, in a known way and under control, to a source of suction or to a source of compressed gas. In this case, the aperture 42' which connects the dosing chamber 22 to the product feed duct 43 consists of a hole of suitable diameter, orientated radially towards the said chamber, positioned at an appropriate distance from the lower end of the said dosing chamber, and opening with an appropriate degree of flaring into the chamber and into the duct 43. The parts made up In this way operate as follows. At the start of each operating cycle, the dosing chambers 22 are closed at their lower ends by the stops 24, 224, the pistons 9' are in the raised position to free the desired spaces in the chambers 22 which are completely filled with product, partly as a result of the suction provided by the said pistons, as indicated by the arrow 48. When the dose D of product has been formed, the pistons 9' continue to provide suction, the stops 24 are lowered, preferably with an initially slow movement away from the dosing chambers 22, and the cross piece 33 with the bases C2 of the capsules is then positioned under these chambers, as shown in FIG. 13, the doses D of product then being discharged into these bases by a downward movement of the pistons 9' which continue to provide suction, at least until they have passed the apertures 42'. When the pistons 9' have completed their downward stroke, as shown in FIG. 14, their connection to the suction source Is broken and the pistons are preferably connected temporarily to a source of delivery of compressed gas as indicated by the arrow 49, to promote the complete separation of the product from the said pistons which are thus left clean and ready for the next cycle. In the next stage, while the cross piece 33 with the bases C2 filled with product is moved away from the filling station, the dosing chambers 22 are closed at their lower ends by the stops 24, 224 and the pistons 9' rise rapidly to the position of the start of the cycle and are re-connected to the suction source 48, as shown in FIG. 15, to enable a new operating cycle to be carried out.

With reference to FIGS. 2 and 16 to 27, a description will now be given of the machine's means, other than those already discussed, for handling the empty and full capsules. In FIG. 2 it will be seen that, for each dosing station, the base of the basket 4 containing the empty capsules is provided with an aperture above the station, through which a set of vertical tubes 50 passes, one tube being provided for each dosing device of the said dosing station, and being fixed in a rapid and removable way, for example by means of the ordinary connection made with a key or pin 51 and a screw 52, to a cross piece 53 fixed on the upper ends of a pair of vertical rods 54 which are guided into the carousel 1 and whose lower ends are fixed to a traveller 55 whose roller 56 follows the double-acting profile of an annular cam 57 fixed on the axial base column B.

Following the upward and downward movement of the tubes 50 through the accumulation of capsules in the periphery of the basket 4, the said tubes, partly as a result of their funnel-shaped upper ends, become filled with capsules C, which are arranged in single file and with their bases pointing up or down in a random way.

Figures 16, 17, 18, 19:
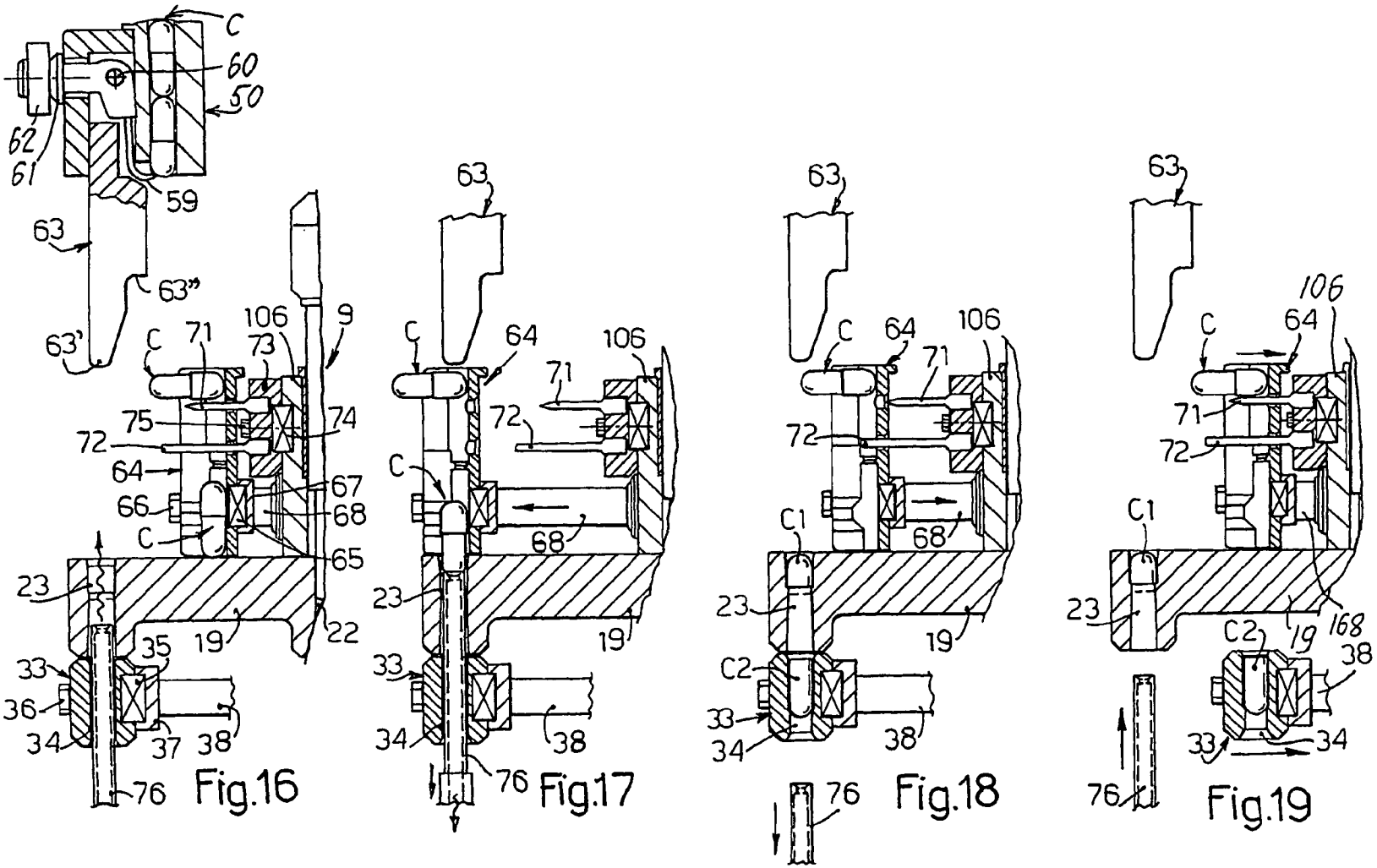
FIGS. 16, 17, 18, 19, 20, 21, 22, 23, 24, 25, 26 and 27 show, on an enlarged scale and in section as in FIGS. 1 and 2, the means of handling the empty and full capsules, in successive stages of operation.
Figure 23:
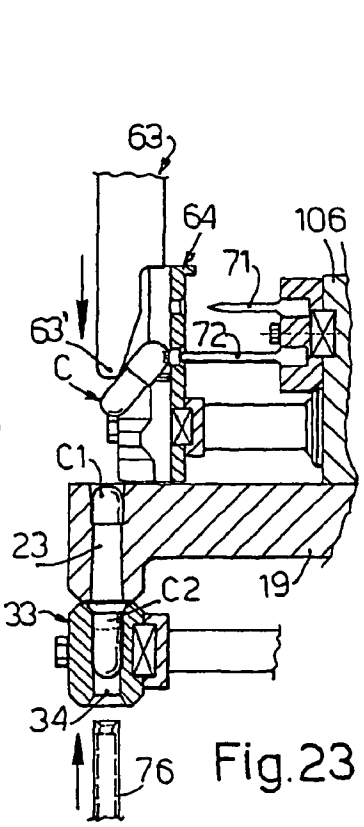
Figure 22:
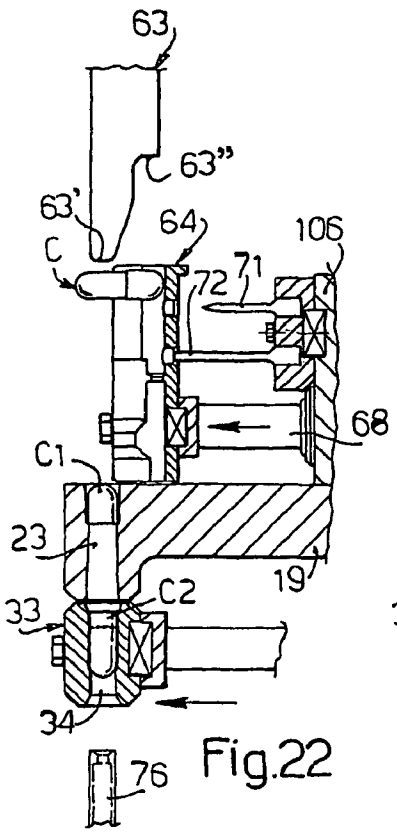
Figure 21:
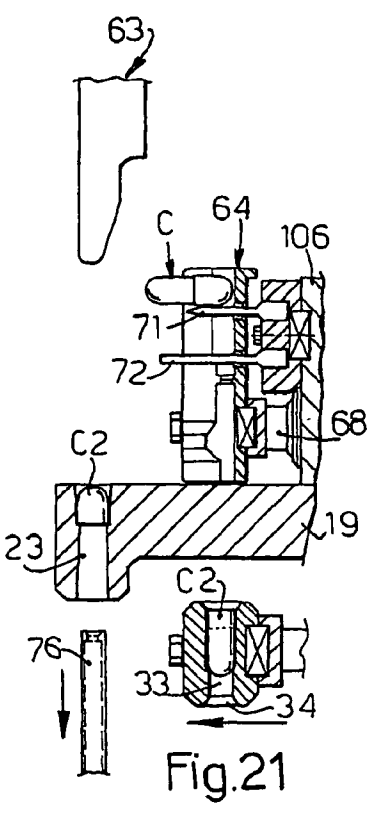

The detail in FIG. 16 shows how an outward-facing side of the set of tubes 50 is provided with a comb-shaped intercepting means 59, which oscillates on a transverse pivot 60, and whose teeth are held, by elastic means 61, with their curved ends under the lowest capsule of each line of capsules aligned in each tube, in order to retain the said lines of capsules, the said comb being provided in its median part and on its outer side with a roller with a horizontal axis 62 which is described more fully below. The set of tubes 50 carries flat pushers 63, in alignment with each tooth of the comb 59, the lower part of each pusher terminating in a tapered portion 63'whose length is correlated with that of the capsules, whose lower point is rounded and whose lateral step 63" has a width correlated with the radius of the capsules to be handled.

Under the set of tubes 50 there is a set of vertical wells 64 of a known type, as described in Italian patent application no. BO2000A-150 cited in the preliminary part of this document, one well being provided for each tube and having its side facing the carousel fixed in a removable and rapid way, for example, by means of a key or pin 65 and a screw 66, to a cross piece 67 whose ends are fixed to a pair of horizontal rods 68 which are guided into the body 6 in the space lying between the dosing chambers 22, and which are guided into the body of the carousel 1 and whose other ends are fixed to a traveller 69 whose roller 169 follows the double-acting profile of a disc cam 70 fixed on the axial base column B. Each well of the set 64 has, in an intermediate position and on the wall facing the carousel 1, apertures which, when the said set of wells 64 is in the position in which it is closest to the carousel, as shown in FIG. 16, are engaged by horizontal points of different lengths 71, 72 fixed on a block 73 which can be fixed in a removable and rapid way to the visible face of the upper appendage 106 of the body 6, for example by an ordinary connection consisting of a key or pin 74 and a screw 75.

The capsule handling means are completed by a set of vertical push rods 76, which are axially hollow and designed for the known connection to a suction source or a compressed air delivery source, and which have dimensions such that they can pass through the housings 34 of the cross piece 33 and the housings 23 of the bracket 19 and have their lower ends fixed to a block 77 designed to be fixed removably and rapidly, for example by means of a key 78 and a screw 79, to a cross piece 80 whose ends are fixed to a pair of rods 81 which are guided into the carousel 1 and whose lower ends are integral with a traveller 82 whose roller 83 follows the double-acting profile of an annular cam 84, which is fixed on the base column B of the machine and which is of the type whose profile can be regulated by a servo controller indicated schematically by the arrow 184, provided with electric motors with electronic speed and phase control, remotely controllable by means of the machine control panel, for adapting this cam to the different characteristics of the capsules to be filled.

Figure 20:
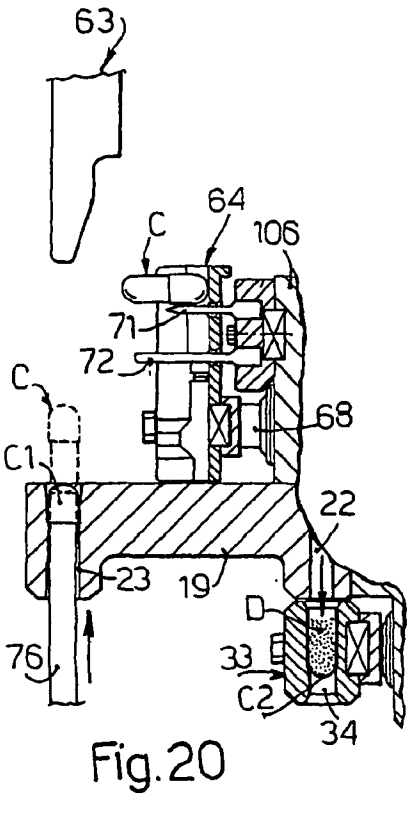
Figure 27:
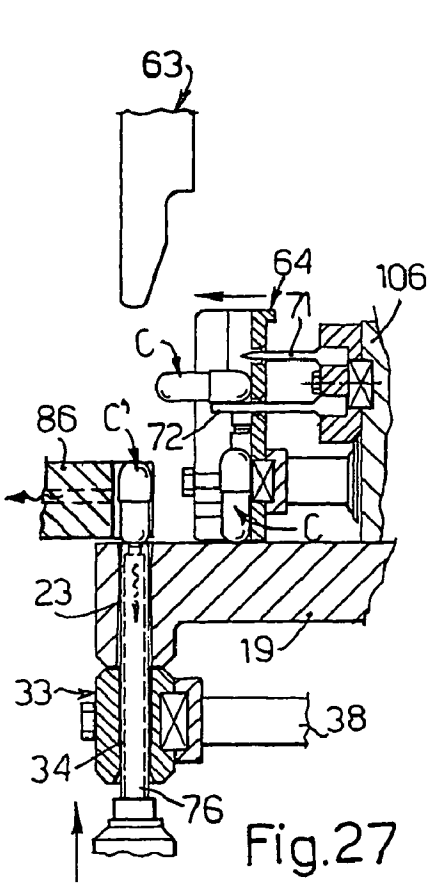
Figure 26:
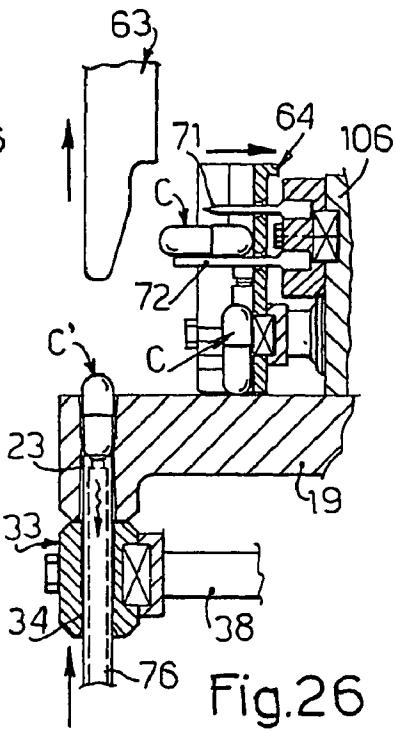
Figure 25:
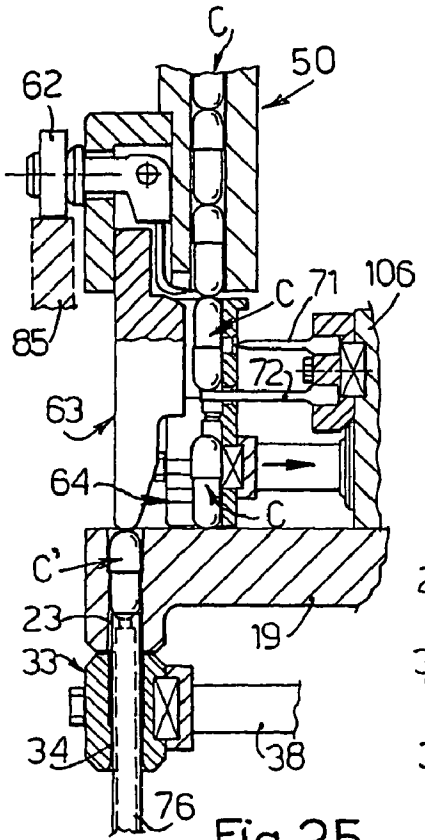
Figure 24:
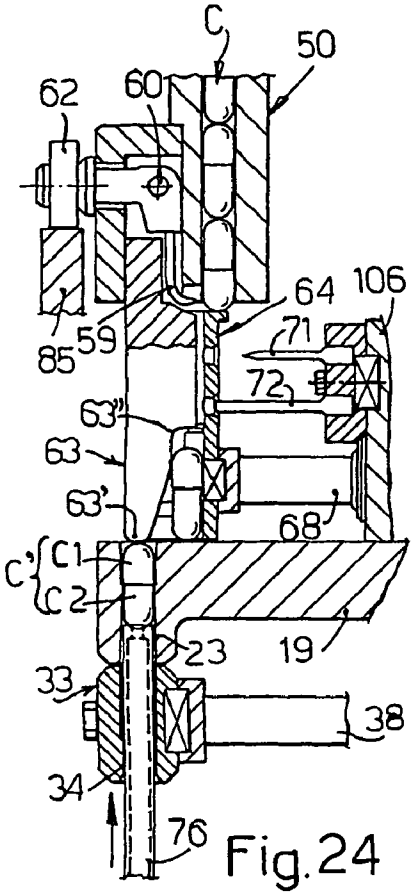

The capsule handling assembly described herein operates in the following way. In the stage shown in FIG. 16, the set of feed tubes 50 is in the raised position and the set of wells 64 is in the withdrawn position of maximum closeness to the carousel 1, with a lower capsule housed in the wider lower portion of each well, in the correct orientation with its cover upwards and having its base bearing on the bracket 19, and with the points 71 which have orientated an upper capsule with its base towards the outside of the said wells. It should be noted that the upper portion of each well is designed to interact with an appropriate degree of friction with the cover of the capsule, so that, in the illustrated example, the upper capsule was previously orientated with its cover upwards. If the upper capsule had previously been orientated with its cover downwards, the said upper capsule would have been orientated by the action of the points 71 with its base again pointing towards the left of FIG. 16, but under the point 71. Also in this stage shown in FIG. 16, the push rods 76 are in the position following that in which a full and closed capsule is expelled, are in the lower parts of the housings 23, and are in the blowing phase for cleaning these housings. In the next stage shown in FIG. 17, the set of wells 64 has been aligned with the housings 23 to feed the capsules located in the lower parts of the said wells into these housings. The push rods 76 rise, are connected to the suction means and then are lowered to transfer the capsules into the housings 23 which, as illustrated in the next stage in FIG. 18, retain the covers C1, while the bases C2 of the said capsules follow the push rods 76 in their downward travel and stop in the upper parts of the housings 34 of the cross piece 33, after which the said push rods 76 stop below this cross piece and cease to provide suction. In the next stage, as shown in FIG. 19, the cross piece 33 with the bases C2 of the capsules is moved transversely towards the filling chambers 22 with the doses of product, as described above, and the wells 64 are further withdrawn towards the carousel to free the housings 23, since in the next stage, shown in FIG. 20, the push rods 76 are raised to the upper ends of the housings 23, suction being provided through the said push rods to prevent undesired displacements of the covers C1. If only the cover C1 of a capsule is present in the housing 23, it remains correctly in position, since the push rod through which suction is provided enters the housing without interference and without undesired displacements. On the other hand, if a capsule C which has not been opened in the preceding stage is present in any housing 23, having possibly become jammed and not only partially closed, this capsule will be lifted out of the housing 23 as indicated in broken lines and will be removed and disposed of by the action of means which are not illustrated. FIG. 20 shows how, in the meantime, the bases C2 of the capsules are being filled with the doses D of product. In the next stages shown in FIGS. 21 and 22, it will be seen that, when the push rods 76 are lowered, while the cross piece 33 with the bases C2 of the capsules filled with the doses D of product moves back into alignment with the housings 23, the set of wells 64 is moved away from the carousel and from the points 71, 72, and is aligned with the steps 63" of the upper pushers 63 which, in the next stage, move downwards together with the set of tubes 50 to which they are fixed, as illustrated in the sequence in FIGS. 23 and 24, to carry out two operations, namely to orientate the capsules, which had previously been orientated by the points 71, with their bases downwards and transfer them into the lower parts of the wells, and to position the points 63' on the upper ends of the housings 23, to act as stops during the closing of the full capsules. These points 63' of the pushers 63 retain the covers C1 of the capsules while the full bases C2 of the said capsules are raised by the push rods 76. FIG. 24 shows how, in the downward travel of the assembly 50, 63, the roller 62 interacts with an annular and fixed track sector 85 which causes the combs 59 to withdraw, so that the bottom combs of the lines of capsules contained in the tubes 50 come to bear on the upper edges of the walls of the wells closest to the carousel 1. In the next stage as shown in FIG. 25, the set of wells 64 is made to withdraw towards the carousel 1 to align the said wells with the tubes 50, in such a way that the last capsule of each tube moves down into one of the said wells, where it is retained by bearing on the point 72. The lower ends of the penultimate capsules in the tubes 50 reach the height of the points of the combs 59, so that they are retained by these points when the set of tubes is raised at the appropriate time and the roller 62 leaves the stop track 85. FIG. 26 shows the aforesaid stage in which the set of tubes 50 with the pushers is raised, while the set of wells 64 is withdrawn towards the carousel 1 for the insertion into the said wells of the upper points 71 which correctly pre-orientate the upper capsules by subjecting them to a rotation in the anticlockwise direction because they were previously orientated with their covers downwards, as a result of which the said pre-orientated capsule is positioned under the point 71. In the next stages shown in FIGS. 26 and 27, it will also be seen that the push rods 76 are made to rise in correct synchronization with the raising of the pushers 63, suction being temporarily provided through the push rods if required, to raise the full and closed capsules C' from the housings 23 and transfer them to the means 86 for collection and removal at the appropriate stage.

Clearly, the set of tubes 50 with the attached parts, the wells 64, the block 73 with the orientation points 71 and 72, the pistons 9 and 9', the brackets 19, the cross pieces 33 with the capsule housings, and the cross pieces 25 and 77 with the stops 24 and the push rods 76 can all be replaced easily and rapidly when there is a change in the format of the capsules to be filled. According to market requirements, the machine can be provided with dosing stations having two or three adjacent operating units, without the need for any modification or replacement of parts of the said machine.

FIGS. 1 and 2 show how, in a preferred embodiment of the invention, and particularly when the machine is to be used for packaging compressible powdered or herb-based products in capsules, the hopper 2 is formed by a lower bowl 102, with perimetric apertures 47 for the outlet of the product P, and is closed in a sealed way by a truncated conical cover 202 whose upper edge interacts in a sealed way with a rotary joint 88 associated partly with the lower flange 189 of a coaxial compensation chamber 89, of cylindrical shape for example, which is fixed to a supporting frame 90 fixed to the base of the machine and which has its lower outlet closed by a valve 94 consisting, for example, of a conical plug which opens into the hopper 2, in such a way that it is pushed to the closed position by the pressure which is constantly present in the said hopper. This is because a duct 91 opens through the flange 189 and is arranged for connection to a source 191 delivering gas at a suitable pressure, according to the characteristics of the product P to be treated and the dimensional parameters of the apparatus, this gas for the internal pressurization of the hopper 2 being preferably of the inert type. The hopper 2 is periodically resupplied with batches of product through the compensation chamber 89, enabling the hopper to operate continuously even when fed cyclically by the means associated with the said compensation chamber 89, which are not discussed here since they are described in a separate patent application in the name of the present applicant.

As a result of the pneumatic pressure at specified and constant levels created in the hopper 2 by the connection to the source 191, the product P is forced to flow towards the dosing chambers 22 of the previously described volumetric dosing units of the machine, to form constant and repeatable doses therein, even when there is a variation of the quantity of product P present from time to time in the said hopper and even when there is a variation of the rotation speed of the said hopper and/or a variation of other parameters, such as the flowability of the product or of the walls of the circuit through which it passes. For their part, the volumetric dosing units are designed to facilitate the flow of product towards them, for example by having small vents between the bases of the dosing chambers 22 and the stops 24, or by having a stage of rapid elevation of the pistons 9, which causes a rapid increase of volume of the dosing chambers and a consequent cavitation effect which is useful for this purpose. The very small quantity of product which passes out through the aforesaid lower vents can easily be removed by small suction apertures, by a method that can easily be implemented by a person skilled in the art.

The gas for the internal pressurization of the hopper 2 also serves to fluidize the product towards the dosing units. However, it should be understood that specific means can be provided in the said hopper and/or in the ducts 45 and 43 for fluidizing the product, provided that the product can withstand the action of these fluidizing means. In FIGS. 1 and 2, for example, the centre of the base 102' of the hopper 2 is shown as having a shaft 87 passing through it rotatably and with a seal, this shaft being made to rotate by suitable means with a small relative motion with respect to the hopper 2, and carrying on its upper end one or more blades 187 which for example terminate at a short distance from the perimetric apertures 47 of the said hopper, in such a way as to improve the fluidity of the product P towards these discharge apertures and consequently towards the volumetric dosing units. The shaft 87 can be made to rotate, for example, by means of a dedicated geared motor or by means of gearing 287 having a gear wheel keyed on a shaft 387 positioned coaxially with the carousel and driven by the same means as those which drive the carousel, in such a way that the blades 187 rotate only as determined by the small speed ratio provided by the gearing 287.

The operating program of the machine includes a stage of opening the valve 93 and all the valves upstream of the product feed device, at the time when cleaning and sterilization fluids are to be passed through all the working parts of the machine in order to prepare the machine for operation with different products. These fluids flow uniformly over the whole internal surface of the hopper 2 and the whole of the circuit through which the product had previously passed, and then pass out freely from both the lower and the upper ends of the dosing chambers 22, the pistons 9 and 109 being designed to be raised above the normal height by the actuator 18 described with reference to FIG. 2, in such a way that all traces of product from the previous operation are removed. Washing liquids can be supplied from above if necessary, by suitable means which are not illustrated, into the dosing chambers 22. All the washing liquid used in the machine, including that supplied by external means, drains into an annular tank 1000 which is fixed on the base of the machine, under the lowest and widest part of the carousel 1 (FIG. 2), and which is provided with means for removing the liquid, which will be analysed, to ensure that no residual particles of product remain, by part of the known means which control the whole machine washing and sterilization cycle.

It should be understood that, as an alternative to or in combination with the pressurization of the hopper 1 from above, the said hopper can be pressurized from below, for example through the hollow shaft 87 and possibly through holes made in the blades 187 which are also hollow. It should be understood that the hopper 2 can also be pressurized for feeding microgranular products, using very small levels of pressurization with respect to those required for feeding compressible powdered or herb-based products or for simply packaging the products in a controlled atmosphere. It should also be understood that the present patent application is also intended to protect an alternative machine which is entirely similar to the carousel machine described and is provided with a limited number of dosing stations which, with the corresponding service equipment, including the hopper 2 with the corresponding feed parts, are mounted on a fixed frame, while the various movements of the movable components are provided by making the cams 84, 17, 32, 57, 41 and 70 of FIG. 2 rotate, or by replacing them with programmable actuators, driven for example by electric motors with electronic speed and phase control. The pressurization of the hopper 2 will provide the same feed parameters as those of a carousel machine. These machines, which are much simpler and less expensive than carousel machines, but entirely similar to the latter, can be used as laboratory machines, to determine the best processing parameters for the products which are to be packaged from time to time on an industrial scale by the more powerful carousel machines.

The invention claimed is:

1. Capsule filler for packaging bulk substances in hard gelatin capsules, of the type comprising a carousel (1) which rotates about its own vertical axis (101) and carries on it a coaxially positioned hopper (2) into which the product (P) for dosing is placed in the loose state, and a plurality of volumetric dosing devices fed with the product from the periphery of the said hopper and closed at their lower ends by external movable stop means, which are removed and replaced, after the dose has been formed, by corresponding housings (34) each of which houses the base (C2) of a capsule and has its upper aperture placed next to the lower end of a dosing device to receive therefrom the dose of product following the downstroke of a piston of the said dosing device, characterized by the use of volumetric dosing devices having their bodies fixed to the carousel (1) and their dosing chambers (22) constantly engaged, from above, by corresponding dosing pistons (9,9') which slide in these chambers with good lateral sealing characteristics, each of said chambers being provided with a lateral aperture (42,42') connected with a seal to the lowest and peripheral part of the hopper (2) to receive therefrom the product for dosing, and being closed at its lower end by an external stop means (24) which can be movable if necessary, and which is designed to close or open this dosing chamber and which, in the opening stage, does not create cavitation phenomena in the said chamber, in order to avoid the disintegration of the dose of product to be transferred into the base of the capsule.

2. Capsule filling machine according to claim 1, characterized in that the lower closing stop (24) of the dosing chamber of each volumetric dosing device is made in the form of a vertical push rod and is connected to axial movement means which raise it in the closing stage and lower it in the opening stage.

3. Capsule filling machine according to claim 2, characterized in that the push rod stop (24) for closing and opening the lower end of each dosing chamber (22) of the volumetric dosing devices used for dosing compressible powdered or herb-based products is provided at its top with a small head (124) which has a round section and a diameter less than that of the body of the said push rod, and which partially engages the lower end of the said chamber (22) with a very small clearance of specified extent, through which a small amount of the gas contained in the dose of product can be vented during the compression stage to which the said dose is subjected before the lowering of the stop in question, or through which air can pass during the lowering of the said stop, to prevent cavitation phenomena in the dosing chamber in the stage of opening the lower end and preparation for the transfer of the dose of product into the base of the capsule.

4. Capsule filling machine according to claim 1, characterized in that the lateral aperture (42,42') of each dosing chamber (22) of the volumetric dosing devices is located at a small distance from the lower end of the said chamber (22).

5. Capsule filling machine according to claim 4, characterized in that, for the dosing of compressible powdered or herb-based products, the lateral aperture (42) of the dosing chamber opens towards the flow of product from the feed hopper (2) with a configuration (242) which is diverging and free of dead zones and opens into the said chamber with a downwardly inclined portion (142), such that an angle of less than 90 is formed above with the axis of the said chamber, and the lower edge of this portion reaches the base of the said dosing chamber (22).

6. Capsule filling machine according to claim 5, characterized in that the downwardly inclined portion (142) of the said lateral aperture (42) of the dosing chamber (22) opens into this chamber with lateral opposing recesses (142) having sharp edges, partly orientated with the appropriate inclination in the longitudinal direction and partly orientated with the appropriate inclination in the transverse direction of the said chamber (22).

7. Capsule filling machine according to claim 5, characterized in that the pistons (9) of the volumetric dosing devices have sharp cutting lower edges.

8. Capsule filling machine according to claim 1, characterized in that, for the dosing of very fluid and non-compressible products, such as those based on microgranules or pellets, the volumetric dosing devices with fixed chambers use pistons (9') whose lower ends are porous, axially hollow and connectable at their upper ends, when so commanded, to a source of suction or of delivery of compressed gas, the dosing chamber (22) of each of the said dosing devices being provided with a lateral aperture (42') for the entry of the product, which is located at a short distance from the lower end of the said chamber and which consists of a small radial hole which opens into the said chamber with a flared edge and which opens towards the product feed flow with a wider flared configuration which is free of dead zones.

9. Capsule filling machine according to claim 8, characterized in that the push rod stops (24) for closing or opening the lower ends of the dosing chambers (22) of the volumetric dosing devices with fixed chambers are such that they close and seal these chambers when they are in the raised position, each of the said stops being provided for this purpose with an insert (224) made from elastic and yielding material which provides the said condition of sealing when it is in contact with the lower part of the body of the dosing device, on which the said dosing chambers open.

10. Capsule filling machine according to claim 1, characterized in that the volumetric dosing devices with fixed dosing chambers (22) are located outside the product hopper (2), in such a way that they can be rapidly replaced when the format of the capsules for filling is changed.

11. Capsule filling machine according to claim 10, characterized in that the dosing devices with fixed dosing chambers (22) are located outside the product hopper (2), at an appropriate distance therefrom, are located at a lower height and on the sides of a polygon which is coaxial with and has a greater diameter than the plan view of the said hopper, in such a way as to promote the free and full outflow of the product initially, and then of the washing and sterilization fluids, through the dosing devices, partly by the action of gravity.

12. Capsule filling machine according to claim 1, characterized in that the volumetric dosing devices are grouped in sets of two or more in a single body (6), for example in sets of two or three, are equidistant from each other, and having their axes on a theoretical vertical plane which is a tangent to the theoretical circumference of the carousel (1) on whose periphery the dosing stations with two or more units as stated above are fixed, one after the other and spaced apart at equal intervals.

13. Capsule filling machine according to claim 12, characterized in that each dosing station comprises a body (6) of essentially rectangular plan, fixed to and projecting from the rotation carousel (1) by means of a suitable fixing (206) and provided, on the wall opposite that used for fixing, with an upper projecting portion (106) through which pass two or more identical vertical holes (7) in which the bodies (109) of the corresponding pistons (9, 9') of the volumetric dosing devices are mounted so that they are slidable in the axial direction, with the interposition of low- friction bushes (8), these pistons moving out of the lower ends of the said holes (7) and sliding axially with a lateral seal into the corresponding volumetric dosing chambers (22) formed in a bracket (19) which is fixed under the said piston guide part (106) and on whose end wall for contact with the said body (6) there open lateral apertures (42, 42&#×0;) of the said dosing chambers, which are connected through seals (44) to corresponding channels (43) which are formed in the said body (6) with a correct convergence towards the axis of the carousel and which open on the upper part of this body, where composite ducts (45) are inserted into these channels with a lateral seal, these ducts having their other ends connected with a lateral seal to corresponding perimetric holes of the base area of the product feed hopper (2).

14. Capsule filling machine according to claim 13, characterized in that the bracket (19) with the dosing chambers (22) contains, in the most projecting part and in a quantity of one for each dosing device, the vertical housings (23) for opening and closing gelatin capsules (C), the said bracket being provided with means (20,21) for removable and simplified fixing to the body (6), in such a way that it can be replaced rapidly when the format of the capsules for filling is changed.

15. Capsule filling machine according to claim 13, characterized in that the pistons (9,9') of the volumetric dosing devices with fixed chambers are fixed at their upper ends, with the interposition of removable and simplified fixing means (10–12) which enable them to be replaced rapidly when the format of the capsules to be filled is changed, to a link (13) whose ends are, in turn, fixed to a pair of vertical rods (15) which extend downwards, are located laterally with respect to the fixed body (6) of each dosing station, are guided into the carousel (1) of the machine and have their lower ends fixed to a traveller (16) whose roller (116) follows the double-acting profile of an annular cam (17) mounted coaxially on the fixed base column (B) of the machine.

16. Capsule filling machine according to claim 15, characterized in that the annular cam (17) for, driving the pistons (9,9') of the volumetric dosing devices with fixed chambers is of the type which comprises remotely controllable means (117) for modifying the inclination, from zero to a specified maximum number of degrees, of the ramps which transmit the axial dosing and compression movement to the said pistons, and consequently to vary the stroke of the said pistons from zero to the desired value.

17. Capsule filling machine according to claim 15, characterized in that the annular cam (17) for driving the pistons (9,9') of the volumetric dosing devices with fixed chambers is mounted on the base column (B) with the interposition of a vertical slider controlled by a servo controller (18) with a remotely controllable motor, so that the said cam can, when so commanded, be moved from a low position, in which the said pistons are in the operating position within the corresponding dosing chambers (22), to a raised position in which the said pistons are raised above the said dosing chambers, to prepare them for replacement or to prepare the whole assembly for the machine washing and sterilization cycle.

18. Capsule filling machine according to claim 2, characterized in that the push rod stops (24) of each dosing station are mounted on a cross piece (25) provided with means (26,27) for removable and simplified fixing to a cross piece (28) whose ends are integral with the upper ends of a pair of vertical rods (29) which extend downwards, are guided into the carousel (1), and have their lower ends integral with a traveller (30) whose roller follows the double-acting profile of an annular cam (32) fixed on the axial base column (B) of the machine.

19. Capsule filling machine according to claim 13, characterized in that a pair of horizontal rods (38)is fixed under the bracket (19) containing the dosing chambers (22) of the volumetric dosing devices, in the space between the push rods of each dosing station, these horizontal rods being guided through the fixed body (6) of each station and being guided into the carousel (1) where they are fixed to a traveller (39) whose roller (40) follows the double-acting profile of a disc cam (41) fixed on the axial base column (B) of the machine, the outer ends of the said rods being integral with a cross piece (37) on which can be fixed in a rapid and removable way a parallelepipedal block (33) having vertical housings (34) whose diameters decrease towards their lower ends and which are movable horizontally, and can be aligned axially, by the movement imparted by the said cam, with the vertical outer housings (23) of the said bracket (19) located above them, to receive from the latter housings the bases (C2) of the capsules which are to be transferred for filling to positions under the dosing chambers (22) and which are then to be returned to a position of alignment with the said housings (23) for reconnection to, and closing with, the covers (C1) of the said capsules.

20. Capsule filling machine according to claim 19, characterized in that the vertical and axially hollow push rods (76), which are vertically movable and pass through the said horizontally movable housings (34) from below, and which initially hold by suction the bases of the empty capsules from the housings (23) of the fixed bracket (19) located above them, and then move downwards to transfer the said bases into the underlying horizontally movable housings, while the covers (C1) of the capsules remain in the housings (23) located above, and which then, when the bases (C2) are full, rise, with the use of suction if necessary, to raise the bases (C2) and close them with the corresponding covers (C1) located above them, these covers being temporarily retained by suitable upper stop means which are subsequently inactivated to allow the full and closed capsule to be raised and expelled by suitable means for collection (86) and removal at the correct time, are fixed to a common cross piece (77) provided with means (78,79) for removable and simplified fixing to a corresponding cross piece (80) whose upper end is integral with a pair of vertical rods (81) which extend downwards, which are guided into the carousel (1) and which have their lower ends integral with a traveller (82) whose roller (83) follows the double-acting profile of an annular cam (84) which is fixed to the axial base column (B) of the machine and which is of the type whose working profile can be modified by remote control by means of servo controllers (184) driven by an electric motor with electronic speed and phase control, to enable the length of travel of the said push rods to be modified in accordance with the format of the capsules to be filled.

21. Capsule filling machine according to claim 1, characterized in that an annular fixed trough (1000) is provided under the dosing stations and under the lowest and widest part of the carousel (1) which carries these stations and the corresponding lower moving auxiliary parts (24,33, 76), this trough collecting and guiding towards an outlet all the washing and sterilization liquids used for cleaning the internal and external parts of the machine, to prepare it from time to time for packaging different products.

22. Capsule filling machine according to claim 1, characterized in that an annular basket (4) is provided coaxially with and outside the hopper (2) containing the product to be dosed and inserted into the capsules, and is supported by the said hopper by means of supports (3), means (5) being provided in a higher position for feeding the empty capsules (C) into this basket, and an aperture being provided in the base of the said basket at the position of each dosing station, each of these apertures having a set of vertical tubes (50) passing through it, these tubes being subjected to an alternating vertical movement so that each of the said tubes, which has a funnel-shaped and externally rounded upper inlet, is filled with a line of empty capsules, with their bases orientated upwards or downwards in a random way, the lines of capsules being retained in these tubes by the bent teeth of a comb (59) oscillating on a transverse pivot (60), held in the closed position by elastic means (61) and provided, on the opposite side to that facing the carousel, with a horizontal roller (62) which, when the set of tubes in question is lowered, interacts with a stop track (85) which is fixed to the base of the machine and which opens the said comb to allow the capsules to drop from the tubes, the said set of tubes (50) being provided with means (51 ,52) for rapid and removable fixing to a cross piece (53) integral with the upper ends of a pair of vertical rods (54) which extend downwards and laterally with respect to the fixed body (6) of the volumetric dosing station, which are guided into the carousel (1), and which have their lower ends integral with a traveller (55) whose roller (56) follows the double-acting profile of an annular cam (57) fixed on the base column (B) of the machine.

23. Capsule filling machine according to claim 22, characterized in that there are provided, in the spaces between the guide housings for the bodies (109) of the dosing pistons formed in the fixed body (6) of each volumetric dosing station, two horizontal guide housings through which pass a pair of rods (68) which also pass slidably through the carousel (1) and which are integral within the carousel with a traveller (69) whose roller (169) follows the double-acting profile of a disc cam (70) fixed on the axial base column (B) of the machine, the outer ends of the said horizontal rods (68) being integral with a cross piece (67) on which can be fixed, by removable and simplified fixing means (65,66), the set of vertical wells of a known type (64) which are open longitudinally on the side opposite that facing the carousel, and each of which has a lower portion in which the capsule can slide freely and an upper portion with a diameter which interacts with friction with the cover of the capsule, and has, on the side facing the carousel, small holes in its lower and intermediate parts, which, when the wells approach the carousel, are passed through by horizontal points of different lengths and of known types (71,72), the lower of these points retaining in the upper part of the well the capsule fed from the tube (50) located above, while the upper point orientates the capsule horizontally and always with the base pointing outwards, these points being integral with the carousel.

24. Capsule filling machine according to claim 23, characterized in that the points (71,72) for retaining and pre-orientating the empty capsules in the set of vertical and horizontally movable wells (64) are fixed on a block (73) which is mounted with removable and simplified fixing means (74,75) on the upper projecting part (106) of the fixed body (6) of each volumetric dosing station.

25. Capsule filling machine according claim 22, characterized in that the set of vertical tubes (50) carries flat downwardly orientated pushers (63), terminating in tapered lower portions having a length suitably greater than that of the capsules, and having a rounded lower point (63') and an upper step (63") on the side facing the set of vertical wells (64) with which the pushers in question interact to push downwards the capsules which have been pre-orientated by the upper points (71), to make the said capsules move into the lower and wider portions of the said wells, still with their bases orientated downwards, means being provided to ensure that the said push rods are positioned, at the end of their downward travel, with their lower points on the housings (23) which contain the covers (C1) of the underlying full bases (02) of the capsules to be closed, to act as stops during the closing of the said capsules.

26. Capsule filling machine according to claim 25, characterized in that it comprises means for enabling the following operational stages to be carried out in succession: the lowering of the set of vertical tubes (50), the opening of the lower end of each tube and the placing of its lowest capsule on the upper edge of a vertical well (64) while the capsule contained in this well and previously pre-orientated horizontally is pushed into the lower part of the said well by a pusher (63) associated with the set of vertical tubes (50), the lower point of each pusher acting as a stop for the stage of closing the bases of the capsules filled with product; the horizontal movement of the set of wells (64) towards the carousel and the alignment of the wells with the tubes (50) positioned above them, and the entry of the intermediate horizontal point (72) into each well to arrest the capsule falling from the said tubes; the raising and simultaneous closing of the lower end of the set of tubes (50) while the set of wells (64) is moved horizontally towards the carousel for the horizontal pre-orientation by the upper points (71) of the capsules previously fed into the wells; the horizontal movement of the set of wells (64) away from the carousel, to disengage the horizontal arresting and pre-orientating points (72,71) and to align the said wells with the underlying housings (23) of the bracket (19) associated with the dosing devices, in order to transfer into these housings the underlying empty capsules ; and the return of the set of wells towards the carousel if necessary, to repeat the stage of horizontal pre-orientation of the upper empty capsules, and the horizontal movement of the said set of wells (64) away from the carousel to realign them with the pushers (63) of the set of vertical tubes (59) located above them, which in the next stage is moved downwards so that the said pushers orientate the capsules with their bases downwards and push them into the lower parts of the said wells, thus preparing the whole machine for the repetition of the cycle which has been described.

27. Capsule filling machine according to claim 26, characterized in that it comprises means for enabling the following operating stages to be carried out in succession: the raising of the vertical push rods (76) through the vertical and horizontally movable housings (34) under the dosing stations; the insertion of these push rods into the corresponding vertical housings (23) of the brackets (19) of the said dosing stations, into each of which the set of wells (64) feeds an empty capsule ; the gripping of the lower bases of these capsules by suction and the lowering of the said push rods until they emerge from the said horizontally movable housings (34) in such a way that the bases of the empty capsules (02) are transferred into these housings while their covers (C1) remain in the upper fixed housings (23); the transfer of the horizontally movable housings (34) with the empty bases of the capsule towards the station for filling with the doses of product; the raising of the push rods (76) into the upper fixed housings (23) which contain the covers of the capsules, with a travel which does not move the said covers but which is capable of expelling any capsule not opened in the preceding stage, the push rods being subsequently made to move downwards again to the lower rest position; when the horizontally movable housings (34) containing the bases of the capsules filled with product are realigned with the fixed seats (23), located above them, of the bracket (19) associated with the dosing devices, the push rods (76) are raised to raise the full bases (02) and to reconnect them to, and close them with, the corresponding covers (C1) located in the upper housings and retained there by the lower points (63') of the said pushers (63) for orientating the empty capsules, which are then raised to allow the push rods (76) to be additionally raised to cause the filled and closed capsules to emerge from the upper parts of the said fixed housings (23), suction being provided through the push rods (76) if necessary in this stage, in order to retain the capsules correctly while they are collected at the correct time by means of removal (86); the lowering of the push rods from the upper fixed housings (23) and the simultaneous cleaning of these with a jet of compressed air; and the raising of the push rods (76) and the provision of suction through them for gripping the next empty capsules and for the repetition of the cycle which has been described.

28. Capsule filling machine according to claim 1, characterized in that it comprises means (91,191) for internally pressurizing the hopper (2) for feeding the product to be dosed, particularly if the product is powdered or herb-based and compressible, with gas which is preferably inert, at specified pressure levels, in such a way that the product contained in the hopper is fluidized and is pushed by the said gas pressure towards the volumetric dosing stations.

29. Capsule filling machine according to claim 28, characterized in that the product hopper (2), which rotates about its own axis, is provided axially with an upper aperture which is connected by means of a rotary joint (88) to the flange (189) of a compensation chamber for the cyclical feeding of batches of product, this chamber being fixed to a fixed supporting frame (90) and being intercepted at its lower end by a normally closed valve (93), a duct (91) for the internal pressurization of the hopper being connected to the said flange (189).

30. Capsule filling machine according to claim 28, characterized in that it comprises mechanical means for fluidizing the product within the hopper (2) and if necessary also in the ducts (45,43) which feed the said product to the volumetric dosing stations.

31. Capsule filling machine according to claim 30, characterized in that the product hopper (2) is round in plan view and is formed by a lower bowl (102) with its base (102') raised towards the centre and closed by a cover (202) of conical and upwardly converging shape, in such a way as to promote the flow of the product towards the perimeter of the base bowl of the said hopper, where there are perimetrically positioned outlet apertures (47) which feed the product to the dosing stations of the machine, this shape of the hopper being additionally useful for ensuring thorough and uniform internal cleaning of this component during the cyclical washing and sterilization stages.

32. Capsule filling machine according to claim 31, characterized in that the base (102') of the hopper (2) is provided axially with an aperture through which a shaft (87) passes rotatably and with a lateral seal, the end of the shaft inside the hopper carrying blades (187) which slowly remix and fluidize the product placed in the said hopper, the said shaft being driven by suitable means (287,387) with a slow rotary movement relative to the said hopper.

33. Capsule filling machine according to claim 32, characterized in that the shaft (87) which carries the blades (187) for fluidizing the product within the hopper (2) can be axially hollow and can be used to send compressed gas into the said hopper, as an alternative to or in combination with the aforesaid means (91).

34. Capsule filling machine according to claim 20, characterized in that it comprises a limited number of volumetric dosing stations of the aforesaid type, which, with their corresponding service equipment, included the hopper (2) with the corresponding pressurized product feed parts, are mounted on a fixed frame, while the various movements of the means of dosing the product and moving the capsules are obtained by making the cams (84,17, 32,57, 41 and 70) rotate, or by replacing them with programmable actuators, driven for example by electric motors with electronic speed and phase control.

* * * * *